US011470896B2

(12) United States Patent
Green

(10) Patent No.: US 11,470,896 B2
(45) Date of Patent: Oct. 18, 2022

(54) HAND GLOVE WITH DUAL ZIPPERS

(71) Applicant: Cheryl Lynne Abraham Green, Brooklyn, NY (US)

(72) Inventor: Cheryl Lynne Abraham Green, Brooklyn, NY (US)

( * ) Notice: Subject to any disclaimer, the term of this patent is extended or adjusted under 35 U.S.C. 154(b) by 0 days.

(21) Appl. No.: 17/579,652

(22) Filed: Jan. 20, 2022

(65) Prior Publication Data

US 2022/0132953 A1 May 5, 2022

Related U.S. Application Data

(63) Continuation of application No. 17/494,933, filed on Oct. 6, 2021.

(51) Int. Cl.
*A41D 19/00* (2006.01)

(52) U.S. Cl.
CPC ..... *A41D 19/0044* (2013.01)

(58) Field of Classification Search
CPC ..... A41D 19/0044; A41D 19/0034; A41D 19/01552; A41D 19/0093; A41D 19/0048; A41F 1/06; Y10S 2/917
See application file for complete search history.

(56) References Cited

U.S. PATENT DOCUMENTS 2,128,796 A * 8/1938 Bohm-Myro ..... A41D 19/0041 2/158
2,268,210 A * 12/1941 Fried ..... A41F 1/06 D2/621
2,516,241 A * 7/1950 Mulheran ..... A41F 1/06 2/160
2,549,660 A * 4/1951 Buhl ..... A41F 1/06 2/158
2,590,015 A * 3/1952 Kennedy ..... A41F 1/06 2/162
3,372,401 A * 3/1968 Woodward ..... A63B 71/146 2/161.4
3,430,265 A * 3/1969 Mazza ..... A41D 19/02 D2/619
3,504,379 A * 4/1970 Glick ..... A63B 71/146 D29/117.1

(Continued)

FOREIGN PATENT DOCUMENTS

FR 2611447 A * 9/1988 ..... A41F 1/06
IT 0116814 A1 * 2/1983 ..... A41F 1/06

*Primary Examiner* — Jillian K Pierorazio
(74) *Attorney, Agent, or Firm* — Michael J. Feigin, Esq.; Feigin and Fridman LLC

(57) ABSTRACT

A hand glove includes a glove body having a dorsal side, a palmar side, a radial side, an ulnar side, and a hand portion including a palm section, a dorsal section, a plurality of digit sheaths, and an opening for providing access to an interior of the glove. The digit sheaths include at least a first sheath corresponding to the first digit of a wearer's hand and second sheath corresponding to one or more of the other digits of a wearer's hand. The radial side includes a first zipper and a first fastening strap. The ulnar side includes a second zipper and a second fastening strap. The first zipper is parallel with and opposite to the second zipper. The dorsal side includes a fastener spanning the dorsal section. The fastening straps are configured to removably attach to the fastener to secure the glove body to a wearer's hand.

20 Claims, 8 Drawing Sheets

(56) References Cited

U.S. PATENT DOCUMENTS 4,040,126 A * 8/1977 Cecil ..... A63B 71/146 2/161.5
4,042,977 A * 8/1977 Antonious ..... A41F 1/06 2/338
D249,749 S * 10/1978 Wanous ..... D2/622
4,615,049 A * 10/1986 Samelian ..... A41D 19/0017 2/163
4,691,388 A * 9/1987 Boone ..... A63B 71/146 2/161.5
D293,850 S * 1/1988 Dzierson, Jr. ..... D2/619
4,850,341 A * 7/1989 Fabry ..... A61F 13/104 601/40
5,073,988 A * 12/1991 Lewis, Jr. ..... A41D 19/0041 2/270
5,088,122 A * 2/1992 O'Toole ..... A63B 71/146 2/161.4
5,444,874 A * 8/1995 Samelian ..... A41D 19/0013 2/917
5,517,694 A * 5/1996 Fabry ..... A41D 19/01582 2/161.4
D397,837 S * 9/1998 Redwood ..... D2/614
5,950,240 A * 9/1999 Carpenter ..... A41D 19/0041 2/160
6,233,742 B1 * 5/2001 Yungkurth ..... A41D 19/002 2/160
6,912,732 B2 * 7/2005 Hatch ..... A41D 19/01558 2/161.1
RE38,948 E * 1/2006 Redman ..... A41D 13/08 2/16
8,726,418 B2 * 5/2014 DeBlasis ..... A41F 1/06 2/161.1
D729,396 S * 5/2015 Games, III ..... D24/207
2009/0100573 A1 * 4/2009 Coulter ..... A63B 71/141 2/163
2011/0197336 A1 * 8/2011 Suk ..... A41D 19/01582 2/161.3
2013/0160186 A1 * 6/2013 Favia ..... A41D 19/0013 2/162
2014/0096306 A1 * 4/2014 Hill ..... A41D 19/0034 2/158
2015/0150322 A1 * 6/2015 Fraga-Rosenfeld ..... A41F 1/06 2/167
2016/0227852 A1 * 8/2016 Hernandez ..... A41D 19/01505
2017/0273375 A1 * 9/2017 Tang ..... A41D 19/01
2019/0082759 A1 * 3/2019 Berry ..... A41F 1/06

* cited by examiner

HAND GLOVE WITH DUAL ZIPPERS

FIELD OF THE DISCLOSED TECHNOLOGY

The disclosed technology relates generally to hand glove. More specifically, the disclosed technology relates to a hand glove including dual zippers for facilitating the donning and doffing of the glove.

BACKGROUND OF THE DISCLOSED TECHNOLOGY

Children typically have a difficult time donning hand gloves. The hand openings at the bottoms of the hand gloves are often too narrow to enable a child to get their hand inside of the glove without help. If the child does ultimately get their hand inside the glove, they then have difficulty getting their fingers into the proper digit sheaths of the glove. This is owing to glove's compressive nature as they are typically tight-fitting and elastically biased toward the user's hand. If the hand opening is made too big or the glove is not tight-fitting then the glove will fall off children's hands easily.

Children however are pretty good at operating zippers and fastening straps, such as Velcro. Accordingly, there is a need for a hand glove including dual zippers and a fastening strap that enable a child to don and doff a hand glove and tighten the glove around his or her hand when donned more easily.

SUMMARY OF DISCLOSED TECHNOLOGY

The disclosed technology provides a hand glove including a glove body having a dorsal side, a palmar side, the dorsal side opposite the palmar side, a radial side, an ulnar side, the radial side opposite the ulnar side, a hand portion defining an interior cavity configured to receive and cover the hand of a wearer, the hand portion including a palm section on the palmar side, a dorsal section on the dorsal side, an upper end including a plurality of digit sheaths protruding outwardly therefrom, and a lower end including a peripheral edge defining an opening for providing access to the interior cavity of the glove body. The hand portion extends from the radial side to the ulnar side. The plurality of digit sheaths include at least a first sheath corresponding to the first digit of a wearer's hand and second sheath corresponding to one or more of the other digits of a wearer's hand. The radial side includes a first zipper and a first fastening strap extending outwardly therefrom. The ulnar side includes a second zipper and a second fastening strap extending outwardly therefrom. The first zipper is parallel with and opposite to the second zipper. The dorsal side includes a fastener spanning the dorsal section. The first fastening strap and the second fastening strap are configured to removably attach to the fastener to secure the glove body to a wearer's hand.

In embodiments, the first zipper and second zipper are coplanar with respect to each other defining a hypothetical plane that divides the glove body in half along a coronal plane of the glove body, thereby separating and defining the dorsal section and the palm section.

In some embodiments, the first zipper extends longitudinally along the radial side from the peripheral edge of the hand portion to the first sheath and the second zipper extends longitudinally along the ulnar side from the peripheral edge of the hand portion to the second sheath.

In certain embodiment, the first zipper includes a length smaller than a length of the second zipper.

In other embodiments, the first zipper includes a length substantially equal to a length of the second zipper.

In embodiments, the first fastening strap is disposed on the palm section of the hand portion midway along a length of the zipper and is configured to lay over the first zipper when attached to the fastener, thereby preventing the first zipper from becoming unzipped. The second fastening strap is disposed on the palm section of the hand portion midway along a length of the zipper and is configured to lay over the second zipper when attached to the fastener, thereby preventing the second zipper from becoming unzipped.

In some embodiments, the fastener comprises a strip of fastening material extending laterally across the dorsal section from the first zipper to the second zipper.

In certain embodiments, the first fastening strap and the second fastening strap comprise a hook and loop fastening material and the fastener comprises a corresponding hook and loop fastening material to enable attachment and disengagement.

In embodiments, the first zipper opens from the peripheral edge to the first sheath enlarging the opening on the lower end of the hand portion at the radial side and the second zipper opens from the peripheral edge to the second sheath enlarging the opening on the lower end of the hand portion at the ulnar side.

In some embodiments, the hand portion includes a first depth at the radial side and a second depth at the ulnar side, wherein the second depth is larger than the first depth.

In certain embodiments, the palm section includes a wrinkled section extending from the first zipper to the second zipper. The wrinkled section opposite the fastener enabling scrunching of the palm section when the first fastening strap and the second fastening strap are attached to the fastener.

In embodiments, the first fastening strap, the second fastening strap, the fastener, and the wrinkled section are coplanar and aligned.

In some embodiments, the first fastening strap and the second fastening strap include substantially the same length and width.

In certain embodiments, the first fastening strap, the second fastening strap, and the fastener include substantially the same width.

"Dorsal" refers to "of, on, or relating to the upper side or back of an animal, plant, or organ, such as the back of a hand". "Palmar" refers to "relating to the palm of a hand." "Radial" refers to "the side of a hand including the thumb or first digit." "Ulnar" refers to "the side of a hand including the pinker finger or fifth digit." "Digit" refers to "a finger or toe including the thumb." "Coronal plane" refers to "any vertical plane that divides the body, or organs thereof, into ventral (underside or front) and dorsal (upper side or back) sections.

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

The present disclosed technology provides a hand glove that facilitates the donning and doffing off the glove, particularly with children. The hand glove comprises a glove body having a dorsal side, a palmar side, a radial side, an ulnar side, and a hand portion including a palm section, a dorsal section, a plurality of digit sheaths, and an opening for providing access to an interior of the glove. The digit sheaths include at least a first sheath corresponding to the first digit of a wearer's hand and second sheath corresponding to one or more of the other digits of a wearer's hand. The radial side includes a first zipper and a first fastening strap. The ulnar side includes a second zipper and a second fastening strap. The first zipper is parallel with and opposite to the second zipper. The dorsal side includes a fastener spanning the dorsal section. The fastening straps are configured to removably attach to the fastener over the zippers to secure the glove body to a wearer's hand.

Figure 1:
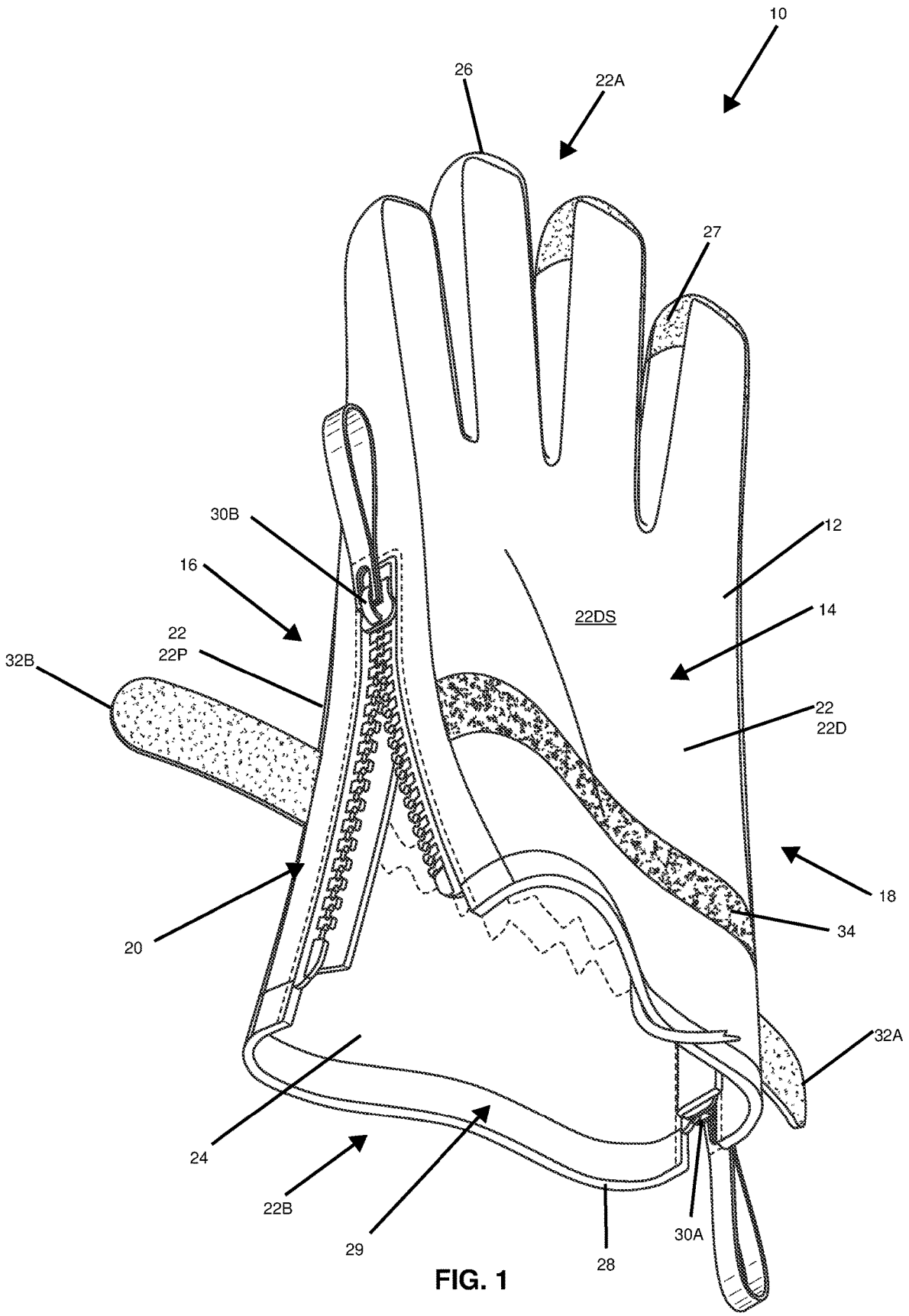
FIG. 1 shows a perspective view of the hand glove illustrating the ulnar side of the glove body according to one embodiment of the present disclosed technology.
Figure 2:
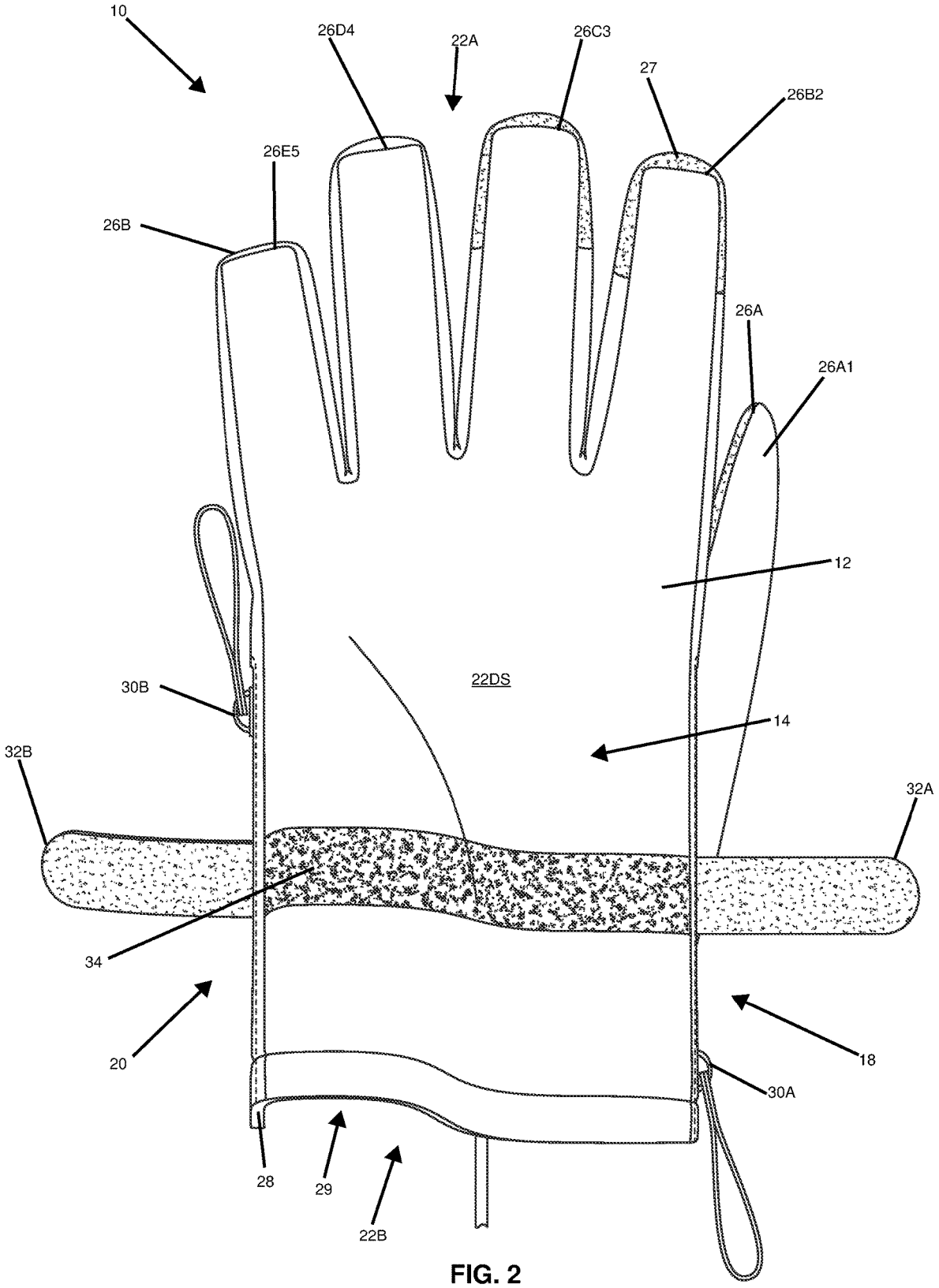
FIG. 2 shows an elevation view of the hand glove illustrating the dorsal side of the glove body according to one embodiment of the present disclosed technology.
Figure 3:
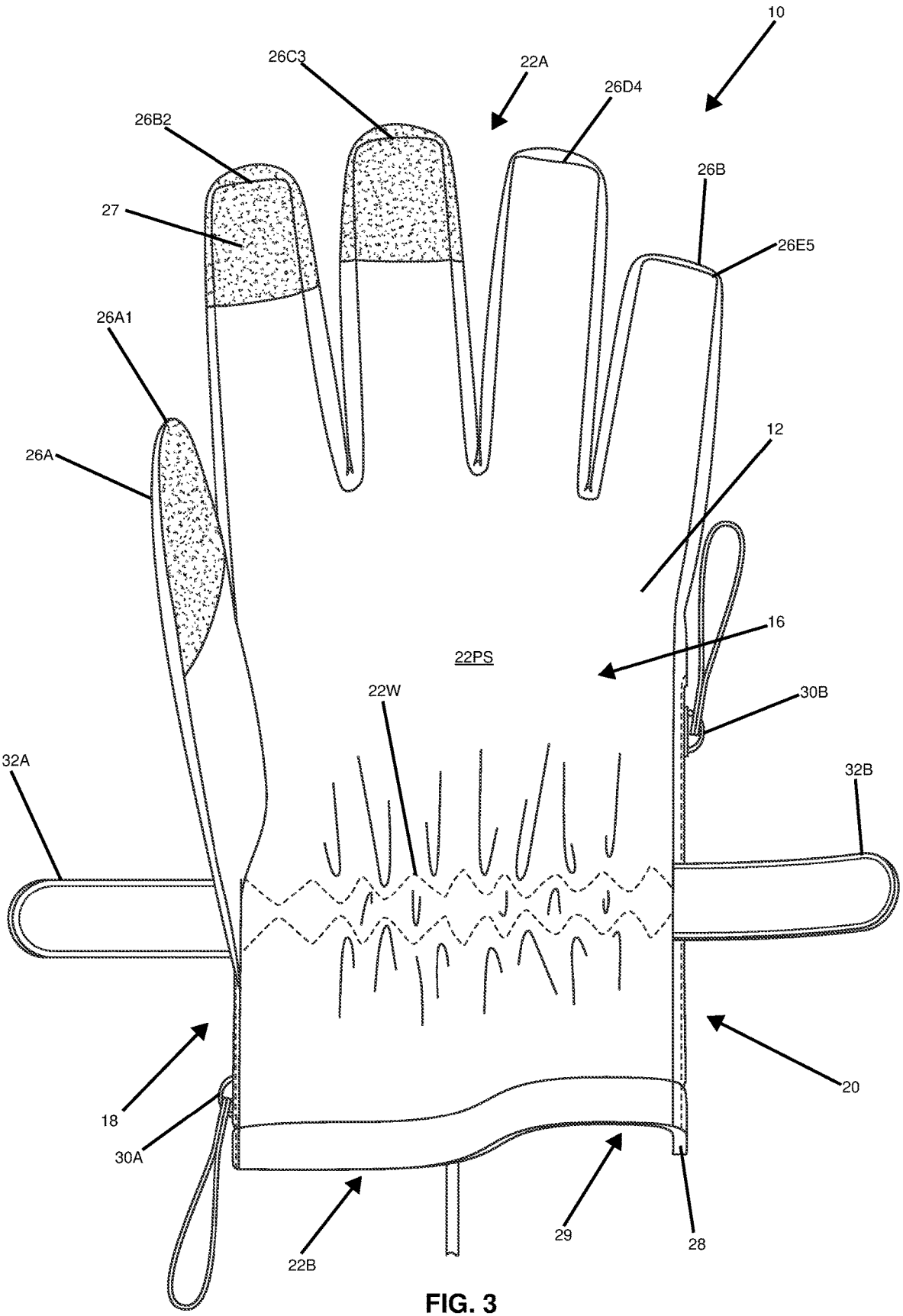
FIG. 3 shows an elevation view of the hand glove illustrating the palmar side of the glove body according to one embodiment of the present disclosed technology.
Figure 4:
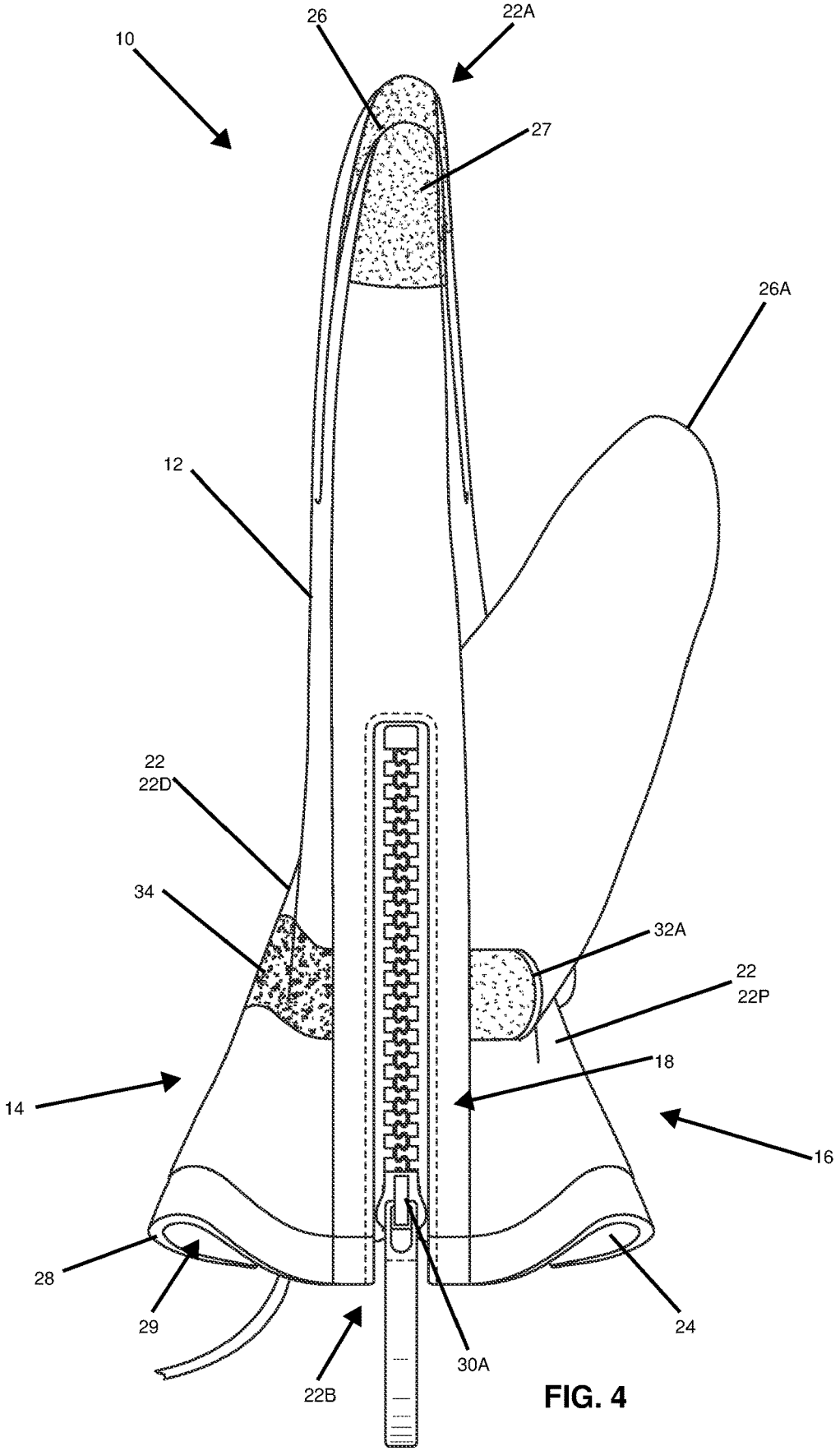
FIG. 4 shows a left-side view of the hand glove illustrating the radial side of the glove body according to one embodiment of the present disclosed technology.
Figure 5:
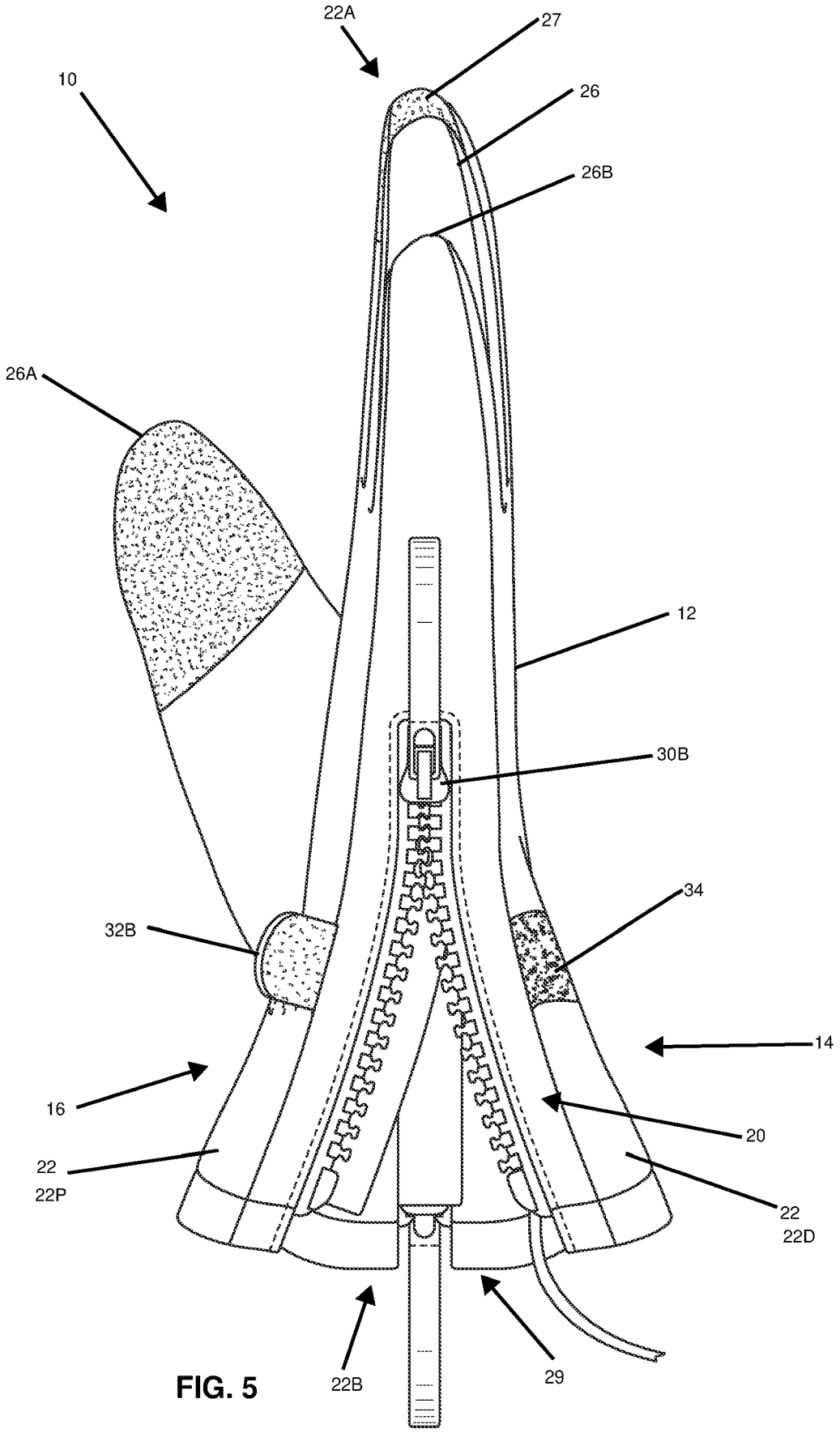
FIG. 5 shows a right-side view of the hand glove illustrating the ulnar side of the glove body according to one embodiment of the present disclosed technology.
Figure 6:
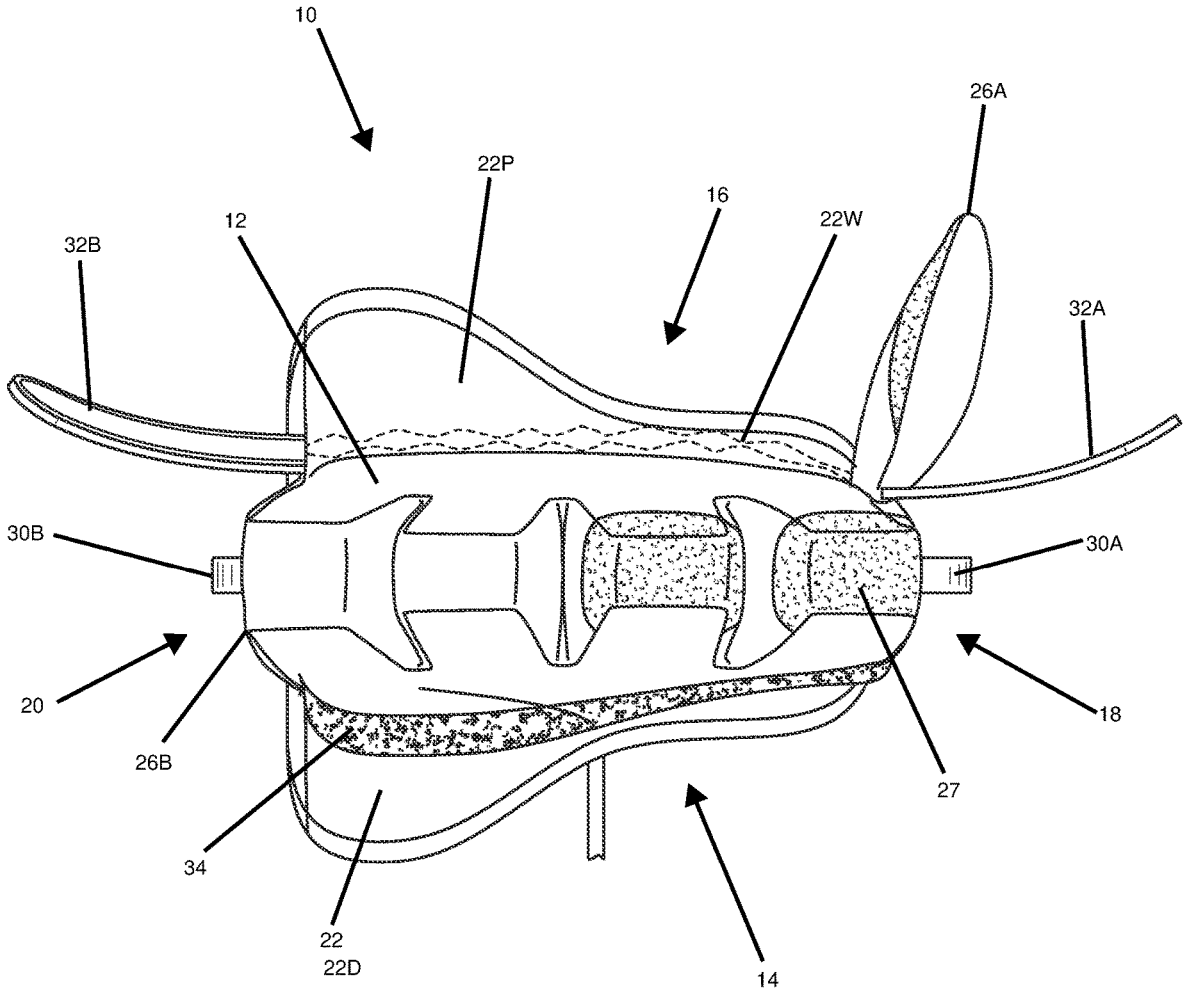
FIG. 6 shows a top-down view of the hand glove according to one embodiment of the present disclosed technology.
Figure 7:
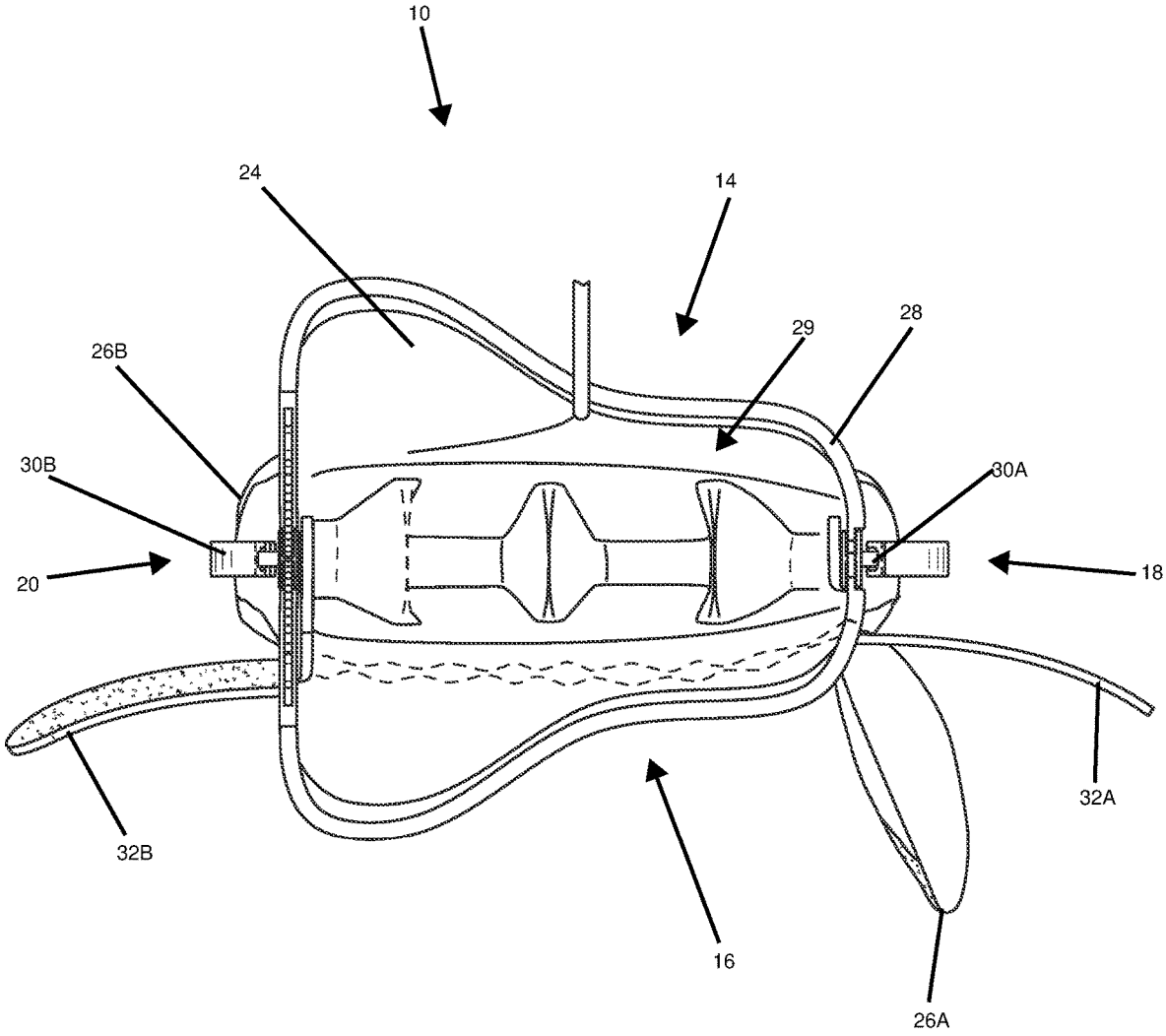
FIG. 7 shows a bottom-up view of the hand glove according to one embodiment of the present disclosed technology.

Referring to FIGS. 1-7, simultaneously, FIG. 1 shows a perspective view of the hand glove illustrating the ulnar side of the glove body according to one embodiment of the present disclosed technology. FIG. 2 shows an elevation view of the hand glove illustrating the dorsal side of the glove body according to one embodiment of the present disclosed technology. FIG. 3 shows an elevation view of the hand glove illustrating the palmar side of the glove body according to one embodiment of the present disclosed technology. FIG. 4 shows a left-side view of the hand glove illustrating the radial side of the glove body according to one embodiment of the present disclosed technology. FIG. 5 shows a right-side view of the hand glove illustrating the ulnar side of the glove body according to one embodiment of the present disclosed technology. FIG. 6 shows a top-down view of the hand glove according to one embodiment of the present disclosed technology. FIG. 7 shows a bottom-up view of the hand glove according to one embodiment of the present disclosed technology.

The present disclosed technology provides a hand glove 10 comprising a glove body 12 including a dorsal side 14, a palmar side 16 opposite the dorsal side 14, a radial side 18, an ulnar side 20 opposite the radial side 18, a hand portion 22 defining an interior cavity 24 configured to receive and cover the hand of a wearer.

The hand portion 22 includes a palm section 22P on the palmar side 16, a dorsal section 22D on the dorsal side 14, an upper end 22A including a plurality of digit sheaths 26 protruding outwardly from the upper end 22A, and a lower end 22B including a peripheral edge 28 defining an opening 29 for providing access to the interior cavity 24 of the glove body 12. The palm section 22P includes a palmar surface 22PS and the dorsal section 22D includes a dorsal surface 22DS. The hand portion 22 extends from the radial side 18 to the ulnar side 20. The hand portion 22 includes a first depth D1 at the radial side 18 and a second depth D2 at the ulnar side 20. In embodiments, the second depth D2 is larger than the first depth D1.

The plurality of digit sheaths 26 include at least a first sheath 26A corresponding to the first digit of a wearer's hand and second sheath 26B corresponding to one or more of the other digits of a wearer's hand. In some embodiments, the plurality of digit sheaths 26 include a first sheath 26A1 corresponding to the first digit of a wearer's hand, a second sheath 26B2 corresponding to the second digit of a wearer's hand, a third sheath 26C3 corresponding to the third digit of a wearer's hand, a fourth sheath 26D4 corresponding to the fourth digit of a wearer's hand, and a fifth sheath 26E5 corresponding to the fifth digit of a wearer's hand. In embodiments, at least one of the finger sheaths 26 includes a finger grip 27 positioned at a distal end thereof, such that the finger grip 27 corresponds to the distal phalange of a user's finger.

The radial side 18 includes a first zipper 30A and a first fastening strap 32A extending outwardly therefrom. The ulnar side 20 includes a second zipper 30B and a second fastening strap 32B extending outwardly therefrom. The first zipper 30A is parallel with and opposite to the second zipper 30B. The first zipper 30A and second zipper 30B are coplanar and define a hypothetical plane that divides the glove body 12 in half along a coronal plane of the glove body 12, which separates and defines the dorsal section 22D and the palm section 22P. The first zipper 30A extends longitudinally along the radial side 18 of the glove body 12 from the peripheral edge 28 of the hand portion 22 to the first sheath 26A. The second zipper 30B extends longitudinally along the ulnar side 20 from the peripheral edge 28 of the hand portion 22 to the second sheath 26B. The first zipper 30A opens from the peripheral edge 28 to the first sheath 26A enlarging the opening 29 on the lower end 22B of the hand portion 22 at the radial side 18. The second zipper 30B opens from the peripheral edge 28 to the second sheath 26B enlarging the opening 29 on the lower end 22B of the hand portion 22 at the ulnar side 20. In embodiments, the first zipper 30A includes a length smaller than a length of the second zipper 30B. In some embodiment, the first zipper 30A includes a length substantially equal to a length of the second zipper 30B. In some embodiments, the palm section 22P includes a wrinkled section 22W extending from the first zipper 30A to the second zipper 30B. The wrinkled section 22W is opposite the fastener 34 and enables scrunching of the palm section 22P when the first fastening strap 32A and the second fastening strap 32B are attached to the fastener 34.

The dorsal side 14 includes a fastener 34 attached to the dorsal surface 22DS and spanning the dorsal section 22D. The fastener 34 may comprise a strip of fastening material extending laterally across the dorsal section 22D from the first zipper 30A to the second zipper 30B. The first fastening strap 32A and the second fastening strap 32B are configured to removably attach to the fastener 34 to secure the glove body 12 to a wearer's hand. The first fastening strap 32A is disposed on the palm section 22P of the hand portion 22 midway along a length of the first zipper 30A. In embodiments, the first fastening strap 32A is disposed at the first sheath 26A. In some embodiments, the first fastening strap 32A is disposed midway between the peripheral edge 28 and the first sheath 26A. The first fastening strap 32A is configured to lay over the first zipper 30A when attached to the fastener 34, thereby preventing the first zipper 30B from becoming unzipped. The second fastening strap 32B is also disposed on the palm section 22P of the hand portion 22 midway between the peripheral edge 28 and the second sheath 26B. In embodiments, the second fastening strap 32B is positioned at midway along a length of the second zipper 30B. The second fastening strap 32B is configured to lay over the second zipper 30B when attached to the fastener 34, thereby preventing the second zipper 32B from becoming unzipped. The first fastening strap 32A and the second fastening strap 32B may comprise a hook and loop fastening material, while the fastener 34 comprises a corresponding hook and loop fastening material to enable attachment and disengagement of the first and second fastening straps 32A, 32B with the fastener 34. In embodiments, the first fastening strap 32A, the second fastening 32B strap, the fastener 34, and the wrinkled section 22W are coplanar and aligned. In some embodiments, the first fastening strap 32A and the second fastening strap 32B include substantially the same length and width. In other embodiments, the first fastening strap 32A, the second fastening strap 32B, and the fastener 34 include substantially the same width.

Figure 8:
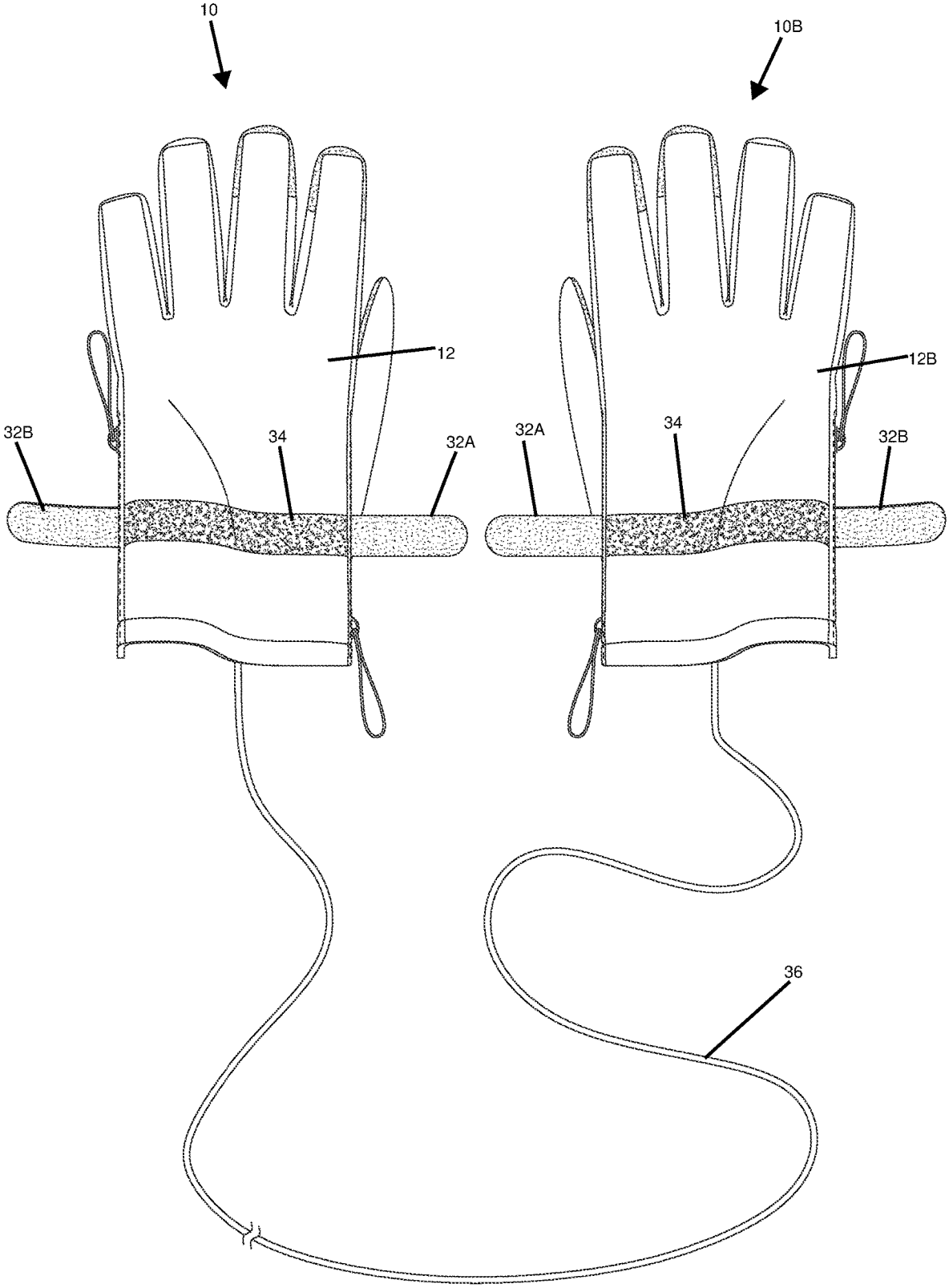
FIG. 8 shows a view of a pair of hand gloves attached together by a tether according to one embodiment of the present disclosed technology.

Referring now to FIG. 8, FIG. 8 shows a view of a pair of hand gloves attached together by a tether according to one embodiment of the present disclosed technology. In embodiments, the hand glove 10 further comprises a tether 36 attaching the glove body 12 to the glove body 12B of the matching hand glove pair 10B. The tether 36 comprises an elongated member including a length at least twice the length of the hand glove 10 and a width less than a width of the fastening straps 32A, 32B and the fastener 34.

Any device or step to a method described in this disclosure can comprise or consist of that which it is a part of, or the parts which make up the device or step. The term "and/or" is inclusive of the items which it joins linguistically and each item by itself.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

What is claimed is:

1. A hand glove, comprising:

a glove body including a dorsal side, a palmar side, the dorsal side opposite the palmar side, a radial side, an ulnar side, the radial side opposite the ulnar side, a hand portion defining an interior cavity configured to receive and cover the hand of a wearer, the hand portion including a palm section on the palmar side, a dorsal section on the dorsal side, an upper end including a plurality of digit sheaths protruding outwardly therefrom, and a lower end including a peripheral edge defining an opening for providing access to the interior cavity of the glove body, the hand portion extending from the radial side to the ulnar side, the plurality of digit sheaths including at least a first sheath corresponding to the first digit of a wearer's hand and second sheath corresponding to one or more of the other digits of a wearer's hand, the radial side including a first zipper and a first fastening strap extending outwardly therefrom, the ulnar side including a second zipper and a second fastening strap extending outwardly therefrom, the first zipper parallel with and opposite to the second zipper, the dorsal side including a fastener spanning the dorsal section, the first fastening strap and the second fastening strap configured to removably attach to the fastener to secure the glove body to a wearer's hand; and wherein at least one of said digit sheaths comprises a finger grip at a distal end thereof;

wherein said fastener comprises a rectangular area, substantially closer to a distal end of said glove than a proximal end thereof, with at least one longest lateral edge thereof substantially parallel to a lower edge of said dorsal side;

wherein said fastener ends at substantially a midpoint of each of said first and said second zippers;

wherein each of said fastening straps comprises:

a substantially rectangular strap area;

a connected edge thereof, corresponding to a first shorter edge of said rectangular strap area, connected to said glove body; and a free edge thereof, corresponding to a second shorter end of said rectangular strap area, comprising a semi-circular shape;

wherein an edge of said first strap is connected to said glove body at a point between said first zipper and said first sheath, on a palmar side of said zipper and on a dorsal side of said first sheath;

wherein an edge of said second strap is connected to said glove body at a point between said second zipper and a wrinkled section, on a palmer side of said second zipper and on a dorsal side of said wrinkled section;

wherein a lateral length of each of said fastening straps comprises substantially half of a lateral length of said fastener;

wherein each of said first and second zippers extends vertically from a distal end of said glove body to a location close to, and vertically beneath, a most-proximal area of connection between said first sheath and said glove body.

2. The hand glove of claim 1, wherein the first zipper and second zipper are coplanar defining a hypothetical plane that divides the glove body in half along a coronal plane of the glove body, thereby separating and defining the dorsal section and the palm section.

3. The hand glove of claim 1, wherein the first zipper extends longitudinally along the radial side from the peripheral edge of the hand portion to the first sheath and the second zipper extends longitudinally along the ulnar side from the peripheral edge of the hand portion to the second sheath.

4. The hand glove of claim 3, wherein the first zipper includes a length smaller than a length of the second zipper.

5. The hand glove of claim 3, wherein the first zipper includes a length substantially equal to a length of the second zipper.

6. The hand glove of claim 5, wherein the first fastening strap is disposed on the palm section of the hand portion midway along a length of the first zipper, the first fastening strap configured to lay over the first zipper when attached to the fastener, thereby preventing the first zipper from becoming unzipped.

7. The hand glove of claim 6, wherein the second fastening strap is disposed on the palm section of the hand portion midway along a length of the second zipper, the second fastening strap configured to lay over the second zipper when attached to the fastener, thereby preventing the second zipper from becoming unzipped.

8. The hand glove of claim 7, wherein the fastener comprises a strip of fastening material extending laterally across the dorsal section from the first zipper to the second zipper.

9. The hand glove of claim 8, wherein the first zipper opens from the peripheral edge to the first sheath enlarging the opening on the lower end of the hand portion at the radial side.

10. The hand glove of claim 9, wherein the second zipper opens from the peripheral edge to the second sheath enlarging the opening on the lower end of the hand portion at the ulnar side.

11. The hand glove of claim 10, wherein the hand portion includes a first depth at the radial side and a second depth at the ulnar side, the second depth larger than the first depth.

12. The hand glove of claim 11, wherein the palm section includes said wrinkled section extending from the first zipper to the second zipper, the wrinkled section opposite the fastener enabling scrunching of the palm section when the first fastening strap and the second fastening strap are attached to the fastener;

wherein an area of said fastener and an area of said wrinkled section are substantially equal;

wherein a location of said fastener on said dorsal side substantially corresponds to a location of said wrinkled section on said palmer side and extends between said first sheath and said second zipper;

wherein said first sheath is between an edge of said wrinkled section and said first zipper.

13. The hand glove of claim 12, wherein the first fastening strap, the second fastening strap, the fastener, and the wrinkled section are coplanar and aligned.

14. The hand glove of claim 13, wherein the first fastening strap and the second fastening strap comprise a hook and loop fastening material and the fastener comprises a corresponding hook and loop fastening material to enable attachment and disengagement.

15. The hand glove of claim 14, wherein the first fastening strap and the second fastening strap include substantially the same length and width.

16. The hand glove of claim 15, wherein the first fastening strap, the second fastening strap, and the fastener include substantially the same width;

wherein said hand glove further comprises a fastening line connected at a first end thereof to a distal end of said dorsal side of said glove body;

wherein said fastening line is connected at a second end thereof to a second glove body, said second hand glove comprising a substantial mirror-image of said hand glove.

17. The hand glove of claim 15, wherein:

the first zipper and second zipper are coplanar defining a hypothetical plane that divides the glove body in half along a coronal plane of the glove body, thereby separating and defining the dorsal section and the palm section; and wherein the first zipper extends longitudinally along the radial side from the peripheral edge of the hand portion to the first sheath and the second zipper extends longitudinally along the ulnar side from the peripheral edge of the hand portion to the second sheath.

18. The hand glove of claim 17, wherein the first zipper includes a length smaller than a length of the second zipper.

19. The hand glove of claim 17, wherein the first zipper includes a length substantially equal to a length of the second zipper;

wherein said hand glove further comprises a fastening line connected at a first end thereof to a distal end of said dorsal side of said glove body;

wherein said fastening line is connected at a second end thereof to a second glove body, said second hand glove comprising a substantial mirror-image of said hand glove.

20. A hand glove, comprising: a glove body including a dorsal side, a palmar side, the dorsal side opposite the palmar side, a radial side, an ulnar side, the radial side opposite the ulnar side, a hand portion defining an interior cavity configured to receive and cover the hand of a wearer, the hand portion including a palm section on the palmar side, a dorsal section on the dorsal side, an upper end including a plurality of digit sheaths protruding outwardly therefrom, and a lower end including a peripheral edge defining an opening for providing access to the interior cavity of the glove body, the hand portion extending from the radial side to the ulnar side, the plurality of digit sheaths including at least a first sheath corresponding to the first digit of a wearer's hand and second sheath corresponding to one or more of the other digits of a wearer's hand, the radial side including a first zipper, the ulnar side including a second zipper, the first zipper parallel with and opposite to the second zipper; a fastening section, comprising: at least one fastener, parallel to an edge of said interior cavity of said glove body, on said dorsal side of said glove body and closer to a distal end of said glove body than a proximal end thereof; and at least two fastening straps extending from opposite sides of said glove body; wherein a first fastening strap of said at least two fastening straps comprises a straight end adjacent to a portion of a palmar edge of said first zipper and a curved end extending outwardly from said glove body; wherein a second fastening strap of said at least two fastening straps comprises a straight end adjacent to a portion of a palmar edge of said second zipper and a curved end extending outwardly from said glove body; wherein said at least one fastener comprises a first straight end adjacent to a portion of a dorsal edge of said first zipper at a location thereof corresponding to said first fastening strap, and a second straight end adjacent to a portion of a dorsal edge of said second zipper at a location thereof corresponding to said second fastening strap; wherein a connection between said straight end of said second fastening strap and said glove body is to a portion of a palmar edge of said second zipper; wherein each of said first and second zippers extends vertically from a distal end of said glove body to a location close to, and vertically beneath, a most-proximal area of connection between said first sheath and said glove body; wherein at least one of said plurality of digit sheaths comprises a distinct finger grip at an end thereof corresponding to a distal phalange of a digit of a wearer's hand.

* * * * *